United States Patent [19]

Hosoya

[11] 4,184,428

[45] Jan. 22, 1980

[54] PERFORATING-PRINTING DEVICE FOR MAKING AND USING THERMAL STENCILS

[75] Inventor: Tadamichi Hosoya, Chiba, Japan

[73] Assignee: Riso Kagaku Corporation, Tokyo, Japan

[21] Appl. No.: 824,215

[22] Filed: Aug. 12, 1977

[30] Foreign Application Priority Data

Aug. 26, 1976 [JP] Japan ..... 51/114253

[51] Int. Cl.[2] ..... B41F 15/20; B41N 1/24; B41C 1/14

[52] U.S. Cl. ..... 101/128.4; 101/125; 101/126; 101/129; 101/470; 250/318; 355/118; 355/120

[58] Field of Search ..... 101/128.3, 128.4, 125, 101/470; 355/70, 93, 113–120; 250/316–318

[56] References Cited

U.S. PATENT DOCUMENTS

| | | | |
|---|---|---|---|
| 1,767,237 | 6/1930 | Clark | 101/125 X |
| 2,225,530 | 12/1940 | Campbell | 355/120 |
| 2,366,722 | 1/1945 | Gaebel | 355/85 |
| 3,904,875 | 9/1975 | Rees et al. | 250/317 |
| 3,964,385 | 6/1976 | Knight | 101/128.3 X |
| 4,091,727 | 5/1978 | Hasegawa et al. | 101/128.4 |

FOREIGN PATENT DOCUMENTS

| | | | |
|---|---|---|---|
| 932589 | 7/1963 | United Kingdom | 250/318 |

*Primary Examiner*—Clyde I. Coughenour
*Attorney, Agent, or Firm*—Stevens, Davis, Miller & Mosher

[57] ABSTRACT

A device which may be operated in a mode of thermally perforating thermal stencils, and another mode of producing printed copies by employing the perforated thermal stencils, wherein the thermal stencils are provided as a particular type of framed assembly for employing a relatively viscous printing ink, the device having a base plate, a cushion plate, and a press plate pivotally mounted to the base plate and having an aperture covered with a transparent rigid plate and a light source unit mounted at the aperture for emitting flash light to the aperture.

18 Claims, 3 Drawing Figures

PERFORATING-PRINTING DEVICE FOR MAKING AND USING THERMAL STENCILS

BACKGROUND OF THE INVENTION

The present invention relates to a perforating-printing device using thermal stencils which is used for thermally perforating thernal stencils in accordance with originals as well as for producing printed copies by employing the perforated thermal stencils.

Thermal stencil duplication which employs thermally perforable stencil sheets for producing printed copies of originals is now widely employed as a means of duplication. As well known in the art, a thermal stencil sheet includes a thermally perforable thin plastic film which is made into a perforated stencil sheet having perforations corresponding to black portions of the original. In performing thermal stencil duplication, a thermal stencil sheet is pressed tightly onto an original which has characters and/or drawings inscribed thereon in a black material such as black ink which absorbs infrared rays. Then radiation including infrared rays is projected onto the original through the thermal stencil sheet, whereby the heat generated by infrared absorption in the black portions of the original melts away the corresponding portions of the thermoplastic film of the stencil sheet so as to produce a perforated stencil sheet. The perforated stencil sheet is then placed over an object which is to be printed, such as a sheet of paper, and printing ink is supplied onto the stencil sheet by means of an inking roller or the like thereby producing a copy printed with patterns corresponding to the perforated portions of the stencil sheet.

As an improvement of such a conventional method of producing printed copies by employing a stencil sheet and an inking roller or the like, it has been proposed in Japanese patent Application No. 30474/75 (Japanese Laying-Open Publication No. 104907/75) to employ a relatively viscous ink having substantially higher viscosity than conventional stencil printing ink in such a manner that the relatively viscous ink is supplied onto a stencil sheet in a relatively thick layer, thereby enabling the stencil sheet to produce a large number of printed copies by repeatedly being pressed onto the copy sheets, without receiving any subsequent supply of printing ink.

Following the invention of the aforementioned new method of stencil printing, a printing device suitable for use with the new printing method has been proposed in Japanese Utility Model Application No. 94408/75 (Japanese Utility Model Laying-Open Publication No. 9504/77). However, this is only a printing device, and for the perforating process of a thermal stencil, a conventional device for perforating thermal stencils is required.

SUMMARY OF THE INVENTION

It is the object of the present invention to obviate the inconvenience of having to use individual perforating and printing devices for performing duplication with thermal stencils, and to provide a novel perforating-printing device for thermal stencils which is capable of perforating thermal stencils as well as of producing printed copies from those stencils.

In accordance with the present invention, the above-mentioned object is accomplished by a perforating-printing device for thermal stencils, comprising a base plate having a cushion plate for placing originals and printing sheets thereon, and a press plate pivotally mounted to said base plate, said press plate having an aperture located so as to face said cushion plate when said press plate is pivoted down against said base plate, a transparent rigid plate which covers said aperture, means for holding a framed stencil at said aperture, and a light source unit adapted to emit flash light to said aperture.

BRIEF DESCRIPTION OF THE DRAWING

The present invention will be more fully understood from the detailed description given hereinbelow and the accompanying drawings which are given by way of illustration only, and therefore do not restrict the present invention in any way, wherein.

DESCRIPTION OF THE PREFERRED EMBODIMENT

Figure 1:
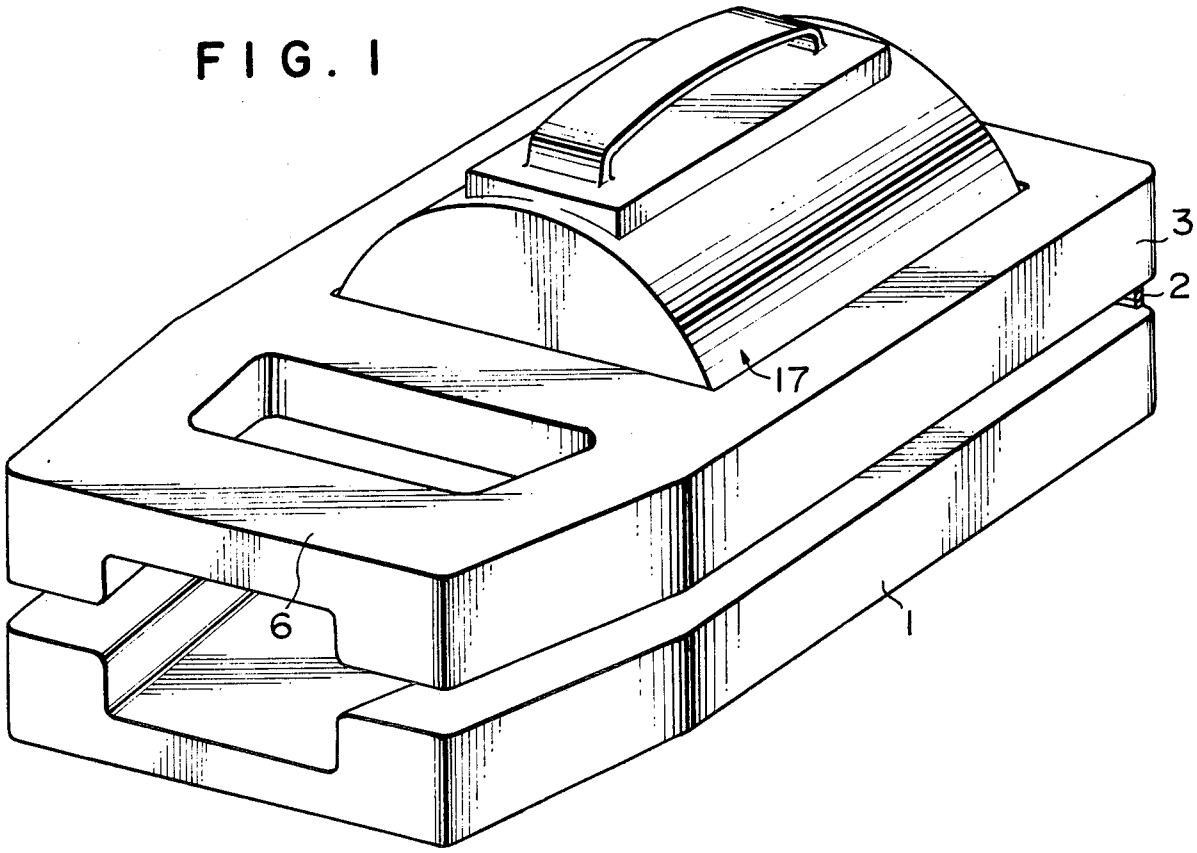
FIG. 1 is a perspective view showing an outside view of a perforating-printing device constructed according to the present invention.
Figure 2:
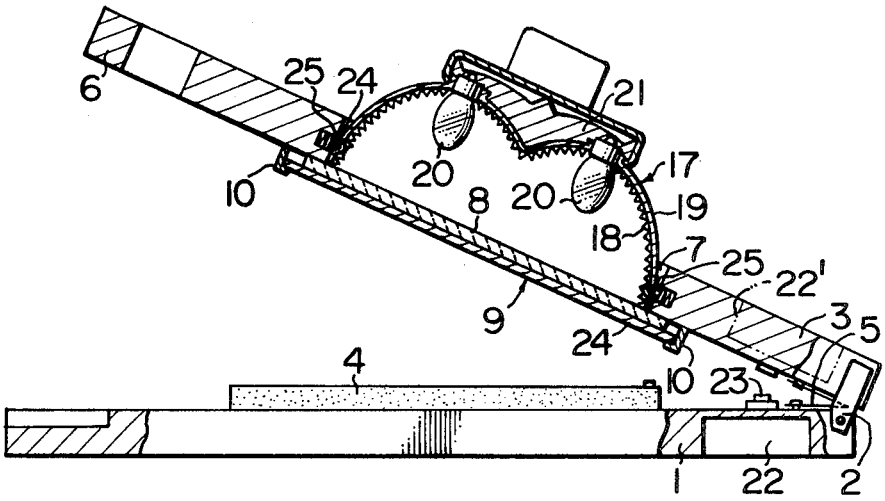
FIG. 2 is a longitudinal sectional view of the device shown in FIG. 1.

Referring to FIGS. 1 and 2, the perforating-printing device herein shown comprises a base plate 1 and a press plate 3 pivotally connected with each other by a pivot means 2. The base plate 1 has a cushion plate 4 mounted at an upper surface thereof for placing thereon an original, when the device is being used for perforating stencils, or objects to be printed, such as sheets of paper, when the device is being used for printing. The cushion plate may consist of a urethane foam plate or the like. The press plate 3 is normally pushed up as shown in FIG. 2 by a leaf spring 5 and can be pivoted down against the base plate by biasing the leaf spring when pressing force is applied to a handle portion 6 formed at the free end portion thereof. The press plate 3 has a rectangular aperture 7 at its center located so as to face the cushion plate 4 when the press plate is pivoted down against the base plate. The aperture is covered by a transparent glass plate 8 mounted to the press plate under the aperture. A framed stencil generally designated by 9 and having a structure as shown in FIG. 3 is detachably mounted at the glass-covered aperture 7 by being slid under a pair of supporting angle bar elements 10 mounted to the press plate along two opposite sides of the rectangular aperture 7.

Figure 3:
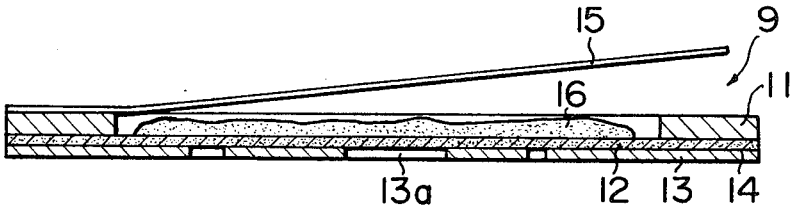
FIG. 3 is a sectional view of a framed stencil suitable for use with the device of the present invention.

The framed stencil 9 shown in more detail in FIG. 3 includes a rectangular ring-shaped frame element 11 made of a relatively thick paper board, to which is mounted a thermal stencil sheet 14 which is a lamination of an ink-permeable supporting sheet 12 and a stretched thermoplastic film 13. On the other side of the frame element 11 an ink-impermeable transparent sheet 15 is provided. This sheet 15 is attached to the frame element along one side thereof thereby providing a kind of cover leaf which may be laid flat against the frame element 11 or lifted up away from it so as to open or close the top of a shallow cavity which is defined by the frame element and the thermal stencil sheet. As explained hereinunder, prior to the printing process, the shallow cavity is charged with a mass of a relatively viscous ink 16 and is closed by the cover sheet 15 thereby providing a framed stencil assembly which incorporates a source of ink.

Coming back to FIGS. 1 and 2, 17 designates a light source unit having a housing 19 which is detachably mounted to the aperture portion of the press plate 3. In the shown embodiment, the housing 19 has a twin parabolic cross-section and opens toward a projection window defined by the transparent glass plate 8 covering the aperture 7, and the inner surface of said housing is covered by a corrugated reflective surface element 18 while two flashbulbs 20 are provided at the foci of the twin parabolically concaved reflector structures, and are mounted to a socket means 21. Adjacent to its open end the housing 19 is formed with indents 24 in which are engaged spring-loaded catches 25 mounted in the wall of the aperture 7, thereby detachably holding the light source unit 17 in the aperture 7 of the press plate 3.

In the shown embodiment, an electric power source unit 22 including an electric cell and a condenser is mounted within the base plate 1 so as to supply an electric current to the flashbulbs 20 by way of an electric circuit including a pressure switch 23, whereby the bulbs 20 are flashed when the pressure switch 23 is closed by the press plate 3 being pivoted over and pressed against the base plate 1 with a predetermined pressing force which is enough to clamp together properly a thermal stencil sheet sandwiched between the glass plate 8 and the cushion plate 4 together with an original, so as to ensure satisfactory perforation when flashing is performed. As a modification, an electric power source unit may be mounted in the press plate 3 as shown by a phantom line and designated as 22'.

In operation, a blank framed stencil 9 is mounted against the glass-covered aperture 7 and is held by the supporting angle bar elements 10 with the thermoplastic film 13 of the thermal stencil sheet 14 facing downward toward the cushion plate 4. An original having characters and/or drawings inscribed thereon in a black material such as black ink which absorbs infrared rays is placed on the cushion 4 and then the press plate 3 is pivoted over and pressed against the base plate 1 by the handle 6. When the press plate is presed against the base plate with a predetermined pressing force which establishes sufficiently tight contact between the thermoplastic film 13 and the original to ensure satisfactory heat conduction from the black portions of the original to the stretched thermoplastic film, thus ensuring satisfactory perforation of the stretched thermoplastic film, the pressure switch 23 is closed, whereby the flashbulbs 20 are flashed by the discharge of electric current from the condenser in the electric power source unit 22, and thermal perforation of the thermal stencil as described above is performed.

After this thermal perforation process, the framed stencil 9 is removed from the press plate 3 and is charged with relatively viscous ink 16 in a sufficient amount estimated to be required for printing a certain desired number of printed copies in the form of an ink layer deposited on the ink-permeable transparent sheet 12 and confined by the frame 11 as shown in FIG. 3. Then, after the cover sheet 15 is placed over the ink layer, the framed stencil 9 is again mounted to the press plate 3 in the same manner as in the previous thermal perforation process so that it is supported by the supporting angle bar elements 10 with the thermoplastic film 13 facing downward toward the cushion plate 4.

An object to be printed, i.e., a printing sheet or a stack of printing sheets, is placed on the cushion plate 4. Then the only printing process which remains to be performed is to pivot the press plate 3 over the base plate 1 and to press the former against the latter by means of the handle 6. In this pressing action, ink from the ink layer 16 is pressed out through the perforations 13*a* formed in the plastic film 13 and is transferred onto the printing sheet, thereby producing a printed copy on the printing sheet, which is inked with a layer of printed ink arranged to follow the characters and/or drawings on the original. Of course one pressing action is required for producing each printed copy. However, no further ink supplying process is required between individual printing actions until the ink layer 16 is exhausted after a certain desired number of printed copies has been obtained. During the printing process the light source unit 17 may be removed from the press plate 3, or it may be left mounted in the press plate as shown in FIG. 2, because the unit, since it is loaded with used flashbulbs, no longer operates even when the pressure switch 23 is closed during the printing process. When the next thermal perforation process is to be performed, the used bulbs 20 must of course be replaced by new ones by detaching the light source unit 17 from the press plate 3.

A xenon lamp or lamps may be used to replace the flashbulbs 20. In this case, a small modification is required with respect to the electric circuit including the pressure switch 23 so that flashing of the xenon lamps is positively avoided in the printing process. However, such a modification will be an obvious matter of design of electric circuitry, and no particular explanation or illustration will be required by one of ordinary skill in the art.

Although the invention has been shown and described with respect to a preferred embodiment thereof, it should be understood by those skilled in the art that various changes and omissions of the form and detail thereof may be made therein without departing from the scope of the invention.

I claim:

1. A perforating-printing device using thermal stencils, comprising:

a base plate having a cushion plate for placing originals or printing sheets thereon;

a press plate, pivotally mounted to said base plate, having a transparent rigid flat plate located so as to face said cushion plate when said press plate is pivoted down against said base plate to permit light access during cutting of said stencil and viewing during printing;

means supported by said press plate for holding a framed thermal stencil at said press plate against said rigid plate so that, when said press plate is pivoted down against said base plate, said transparent rigid plate exerts substantially uniform pressure on said stencil over substantially its entire surface; and a light source unit removably mounted to said press plate as opposing said transparent rigid plate so as to be able to radiate flash light to said thermal stencil.

2. The device of claim 1, wherein said press plate is made of an opaque maerial and has an aperture located so as to face said cushion plate when said press plate is pivoted down against said base plate.

3. The device of claim 2, further including an electric power source unit mounted in said base plate and supplying electric power to said light source unit.

4. The device of claim 2, further including an electric power source unit mounted in said press plate and supplying electric power to said light source unit.

5. The device of claim 2, wherein the said light source unit is provided with indents while said press plate has spring-loaded catches mounted in the wall of said aperture, said catches being removably engageable with said indents so that the light source unit is detachably held in said aperture of said press plate.

6. The device of claim 5, further including an electric power source unit mounted in said base plate and supplying electric power to said light source unit.

7. The device of claim 5, further including an electric power source unit mounted in said press plate and supplying electric power to said light source unit.

8. The device of claim 1, wherein said light source unit includes a socket means for mounting a flashbulb.

9. The device of claim 8, further including an electric power source unit mounted in said base plate and supplying electric power to said light source unit.

10. the device of claim 8, further including an electric power source unit mounted in said press plate and supplying electric power to said light source unit.

11. The device of claim 1, wherein said light source unit has a housing having a twin parabolic cross-sectional shape having two foci and two socket means located in such a position that flashbulbs detachably mounted therein, which are two in number, are each at one of said foci.

12. The device of claim 11, further including an electric power source unit mounted in said base plate and supplying electric power to said light source unit.

13. The device of claim 11, further including an electric power source unit mounted in said press plate and supplying electric power to said light source unit.

14. The device of claim 1, wherein a pressure switch is provided so as to be actuated by the relative pivoting movement of said base plate and said press plate, said pressure switch being closed when said press plate is pivoted over and pressed against said base plate, and controlling the flashing of said light source unit.

15. The device of claim 14, further including an electric power source unit mounted in said base plate and supplying electric power to said light source unit.

16. The device of claim 14, further including an electric power source unit mounted in said press plate and supplying electric power to said light source unit.

17. The device of claim 1, further including an electric power source unit mounted in said base plate and supplying electric power to said light source unit.

18. The device of claim 1, further including an electric power source unit mounted in said press plate and supplying electric power to said light source unit.

* * * * *